United States Patent [19]

Miyashita et al.

[11] 4,412,862

[45] Nov. 1, 1983

[54] METHOD FOR THE PRODUCTION OF FERROCHROMIUM

[75] Inventors: Tsuneo Miyashita; Tsutomu Fukushima; Kiyoshi Kawasaki; Sadayuki Sasaki, all of Yokohama, Japan

[73] Assignee: Nippon Kokan Kabushiki Kaisha, Tokyo, Japan

[21] Appl. No.: 399,974

[22] Filed: Jul. 20, 1982

[30] Foreign Application Priority Data

Jul. 21, 1981 [JP] Japan ..... 56-112936

[51] Int. Cl.[3] ..... C22C 33/00

[52] U.S. Cl. ..... 75/130.5

[58] Field of Search ..... 75/130.5

[56] References Cited

U.S. PATENT DOCUMENTS 3,791,819 2/1974 Loutzenhiser ..... 75/130.5

3,834,899 9/1974 Tanabe ..... 75/130.5

*Primary Examiner*—P. D. Rosenberg

*Attorney, Agent, or Firm*—Fleit, Jacobson, Cohn & Price

[57] ABSTRACT

Described is a method for the production of ferrochromium and a rotary furnace employed in such method. Raw chromium ores, fluxes and carbonaceous reducing agent(s) are charged into a rotary furnace into which oxygen or oxygen-enriched air is blown to effect smelting reduction. Hot exhaust gases from the rotary reducing furnace are used for pre-heating and pre-reducing of the materials for saving the energy considerably as contrasted to conventional methods.

7 Claims, 5 Drawing Figures

METHOD FOR THE PRODUCTION OF FERROCHROMIUM

BACKGROUND OF THE INVENTION

This invention relates to a method for the production of ferrochromium with use of a rotary furnace. More particularly, it relates to such method wherein expensive electric power is not used as in the conventional electric furnace method but a carbonaceous reducing agent such as coke or coal is burned in the rotary furnace in the presence of oxygen and raw chromium ores pre-heated or pre-reduced and charged into the rotary furnace are turned under the heat of combustion into ferrochromium by smelting reduction.

Heretofore, in the production of high carbon ferrochromium, the raw materials including raw chromium ores, reducing agent such as coke and fluxes such as lime or silica are charged consecutively into a submerged arc type electric furnace for smelting. By this method, an electric power of 3000 to 3700 KWH is required per each ton of ferrochromium which means a considerable electric power consumption. In consideration of the markedly inferior conversion efficiency from the valuable liquid fuel to electric energy, it is nowadays of vital importance to develop a technique whereby the consumption of a large quantity of electric power may be avoided.

From this standpoint, various methods for the production of ferroalloy or alloy steels by smelting reduction through use of a rotary furnace, and the rotary furnace used in these methods, have been proposed e.g. in the Japanese Patent Publications Nos. 13043/1965 and 23731/1969. The Japanese Patent Publication No. 13043/1965 shows the method for smelting reduction of the ores in a rotary furnace by using solid reducing agent such as coal and coke. In this method, however, the ores are limited to iron ores and the upper limit of the smelting temperature is set up to 1450° C. for protection of the refractory material. In spite of such limitation, in case of reduction of iron oxides, the refractory material may be attacked by molten iron oxides yielded in the smelting process. Because of this problem, the method of the Publication No. 13043/1965 has not been practiced commercially.

The Japanese Patent Publication No. 23731/1969 shows the method for production of ferroalloys or alloy steels through smelting reduction making use of a rotary furnace. With this method, the heat source for smelting is limited to oxygen-natural gas or heavy oil or oxygen-carbon monoxide yielded by reducing reactions. Hence it is not possible to use coke or coal which may be readily available at lower costs. It is stated that the materials can be pre-heated or pre-reduced by exhaust gases from a reducing furnace, however, no mention has been made of the method or apparatus for utilizing such exhaust gases.

In view of these inconveniences, the present invention eivisages to provide a method for the production of ferrochromium wherein total energy consumption of the process may be reduced by about 25 percent as compared to the electric furnace method through (a) using coal and coke that are available readily and at reduced costs, (b) blowing fuel and oxygen for promoting the smelting of raw materials, shortening the blowing time and improving the productivity, (c) utilizing exhaust gases of the rotary furnace for pre-heating or pre-reducing of raw ores for recovery of waste heat.

SUMMARY OF THE INVENTION

The present invention resides in a method for the production of ferrochromium characterized in that raw chromium ores, fluxes and a carbonaceous reducing agent(s) are charged into a rotary furnace having a horizontal or gently sloping axis, and smelting reduction is caused to take place while oxygen or oxygen-enriched air is blown into the furnace.

According to one aspect of the invention, hot exhaust gases from the rotary furnace are introduced to a rotary kiln, shaft furnace or a fluidized bed to effect the pre-heating or pre-reducing of the charge's and the raw chromium ores.

DESCRIPTION OF THE PREFERRED EMBODIMENT

The inventive method for the production of ferrochrom will now be described in detail.

Raw Cr-Ores such as fine and lumpy ores and Cr-Ore agglomerate such as pellets and briquetts (also carbon-containing agglomerate) could be charged in the present invention. By carbonaceous reducing agents are meant coke, coal, mixture of coke and coal, mixture of coke and coal with pulverized coal injection, or a water-coal slurry injection.

Figure 1:
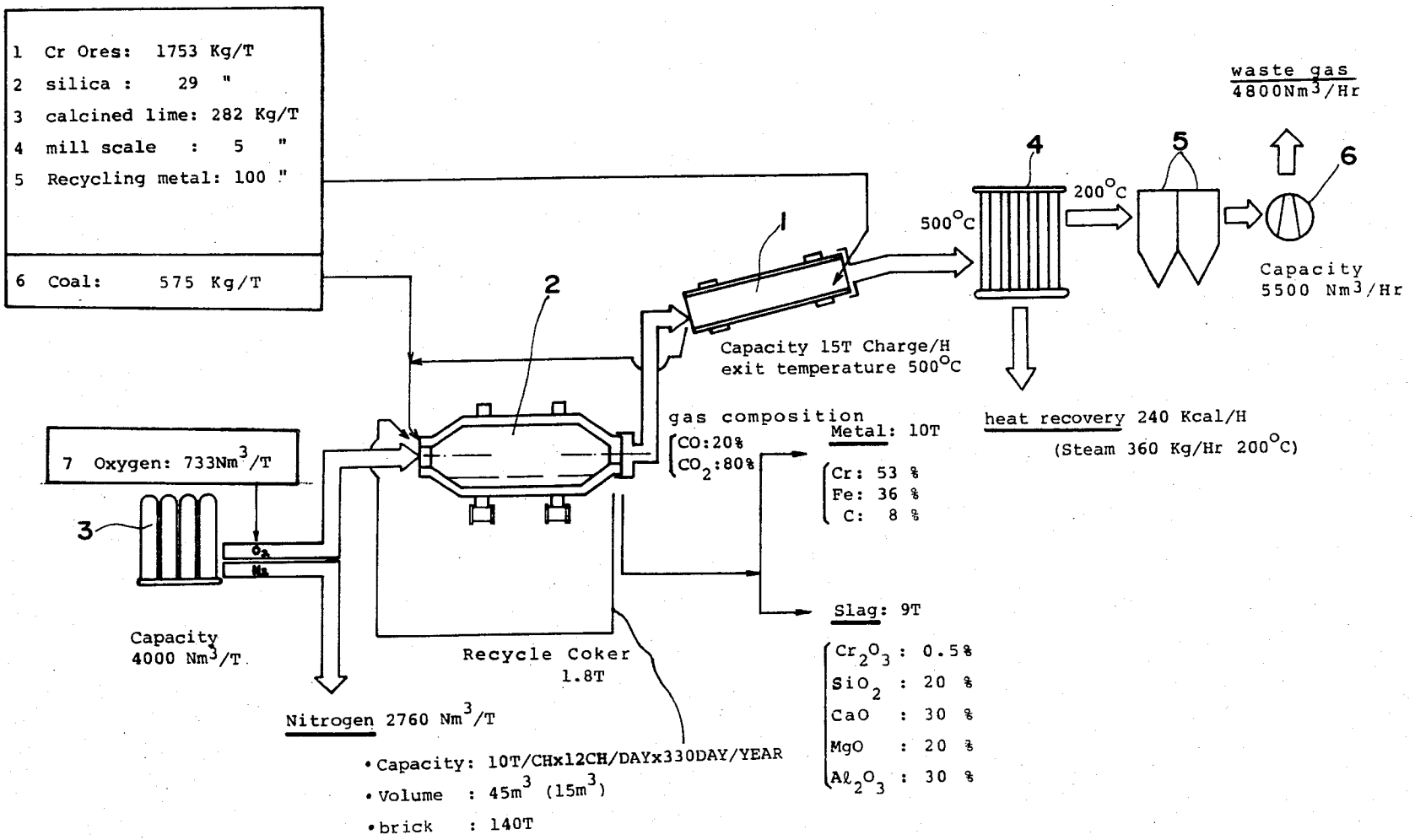
FIG. 1 is a diagram showing the basic process of the present invention.

An example of the method for production of ferrochromium will be described in accordance with the process diagram shown in FIG. 1, which is a basic process diagram of the present invention. The numeral 1 denotes a rotary kiln for pre-heating or pre-reduction of raw chromium ores. The rotary kiln may be replaced by any other furnace such as shaft furnace or fluidized bed provided that such furnace allows to keep the heating temperature up to 1800° C. necessary for such pre-heating or pre-reduction. As raw chromium ores to be charged into rotary kiln 1, lumpy and/or fine chromium ores, powdered fired or cold-bonded pellets or briquettes, could be used. Silica limestone (calcined lime or quick lime) or mill scale are also charged as fluxes. FIG. 1 shows the recorded values obtained from test operation. The heat supplied to the rotary kiln 1 is derived from exhaust gases at 1200° to 1250° C. exhausted from a rotary furnace 2 to be described later and composed of about 20 percent of CO and 80 percent of $CO_2$. In the present Example, these gases are burned further in the rotary kiln so as to be the source of pre-heating. The rotary furnace 2 shown is the horizontal rotary furnace opened at both ends, but the furnace may be opened at one end only or tilted with a maximum tilt angle of 35 degrees. The raw chromium ores and fluxes which have undergone pre-heating or pre-reduction in the rotary kiln 1 are charged directly into the rotary furnace, at the same time that solid fuel reducing agents are also charged into the furnace where oxygen or oxygen-enriched air is also supplied under pressure for smelting and reducing the materials for production of ferrochromium and slags. As typical of the solid fuel reducing agent(s), charged into the rotary furnace, coke, coal, mixture of coke and coal, mixtures of coke, coal with pulverized coal injection or coal slurry or emulsion injection may be mentioned. In the drawing, 3 denotes an apparatus for preparation of oxygen, 4 a heat exchanger, 5 an electrical dust precipitator and 6 a suction type fan. According to the present invention, exhaust gases from a rotary furnace are used as heat source for pre-heating or pre-reduction. The exhaust gases from a furnace used for such pre-heating or pre-reduction, such as rotary kiln, are passed through heat exchanger (4) for heat recovery and through electrical dust precipitator (5) for dust removal. The figures affixed to each process in FIG. 1 represent recorded values in the test operation.

The present invention will be described further by referring to several examples thereof.

EXAMPLE 1

Figure 2:
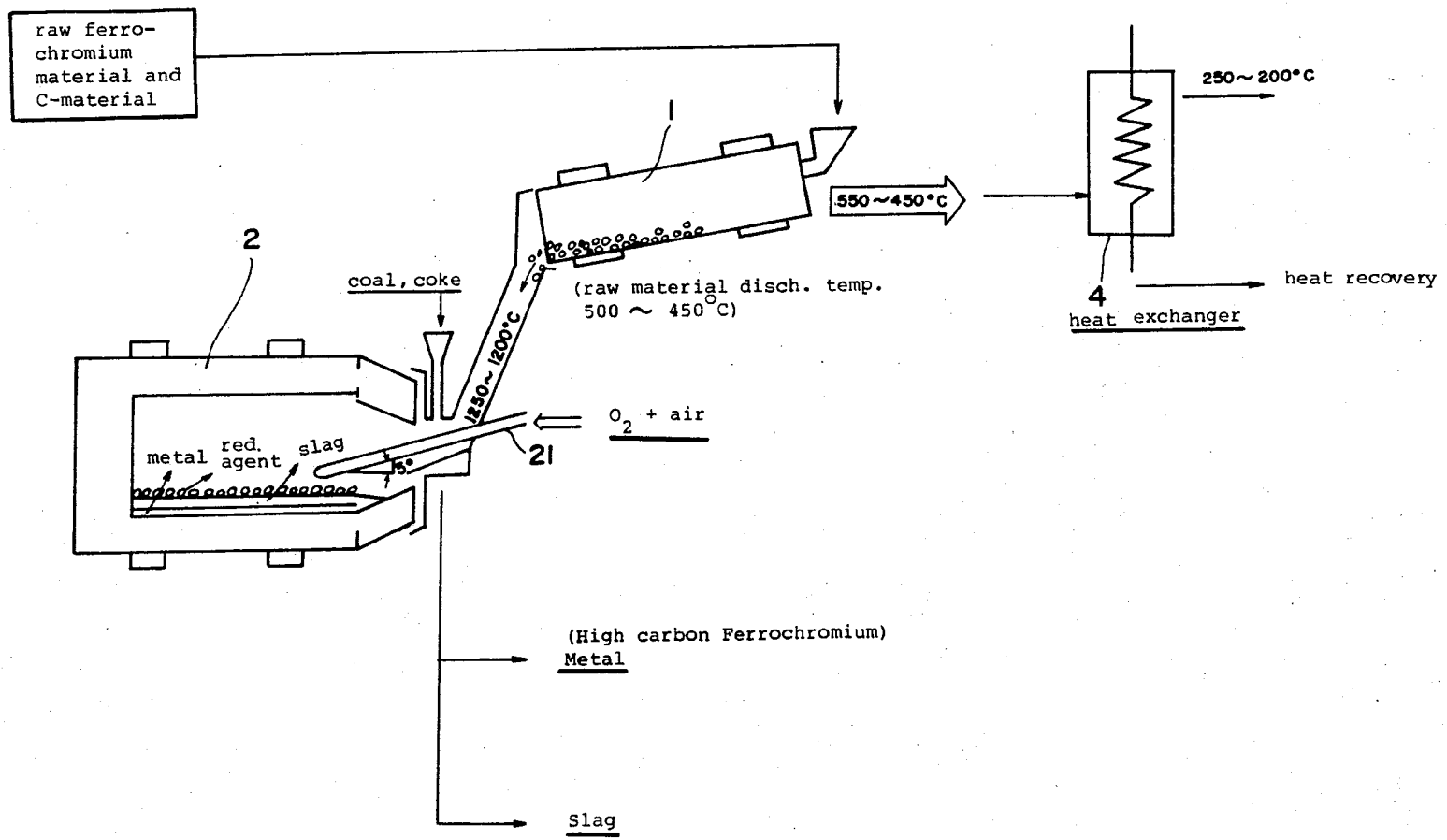
FIG. 2 is a diagram showing the process of the first embodiment of the invention.

This Example refers to the production of high carbon ferrochromium. The apparatus shown in FIG. 2 is used for production of 1 ton of high carbon ferrochromium.

The rotary furnace 2 open at one end (inside diameter, 1 m; outside diameter, 2 m; length, 3 m) was rotated at 8 rpm with the axis horizontal. The raw materials, fluxes, coke and coal were pre-heated to about 500° C. in the rotary kiln 1, mixed together and charged through the inlet of the rotary furnace 2. The mixture consisted of 1900 kg of chromium ores, 254 kg of calcined lime, 26 kg of silica, 5 kg of mill scale, 400 kg of coal and 400 kg of coke, with the size of the raw materials and fluxes being less than 20 mm and the size of coke and coal being in the order of 5 to 12 mm.

Oxygen was blown onto the surface of coke and coal from a water-cooled lance 21 inclined 15 degrees relative to the rotary axis of the rotary furnace 2. Oxygen blow was started at the rate of 10 $m^3$ per minute and the materials were smelted in about 50 minutes. The slag temperature at this time was 1650° C. After about ten minutes, 300 kg of additional coke and coal were charged at the charging rate of 10 kg per minute for forming a bed layer of predetermined thickness on the slag surface. Oxygen was blown at 6 $Nm^3$/minute during the 50–60 minute interval and at 3 $Nm^3$/minute during the 65 to 80 minute interval. Oxygen blow was terminated in 80 minutes and the molten metal was tapped out. The slag temperature at this time was 1720° C.

The metal and slag of the following weight and chemical composition (wt. percent) were obtained.

| | Cr | Fe | Si | | C |
|---|---|---|---|---|---|
| metal, 1000 kg | 53.5% | 36.5% | 1% | | 8% |
| | $Cr_2O_3$ | $SiO_2$ | CaO | $Al_2O_3$ | MgO |
| slag, 1200 kg | 0.5% | 20% | 31% | 31% | 27% |

A skimmer was attached at the time of tapping to the tapping hole or mouth to cause residual excess coke to remain in the furnace for recirculation.

The gas generated in the process of smelting reduction of the ores had the composition $CO/CO_2$ equal to 20/80 and was exhausted at about 1200° C. The gas was conducted to a rotary kiln 1 (capacity, 1500 kg/hour; inside diameter, 1 m; length, 10 m; 1 rpm) for preheating 800 kg per hour of Cr ores, 13 kg per hour of silica, 127 kg per hour of calcined lime and 25 kg per hour of mill scale. The raw materials and the fluxes were charged into the rotary furnace and the discharge temperature thereof from the rotary kiln 1 was kept at 500° C. by blowing the air into the rotary kiln at a rate of 1.5 N $m^3$ per minute. The gases discharged at 500° C. or thereabouts from the rotary kiln 1 were passed through heat exchanger 4 for heat recovery at a rate of 20000 kcal/-hour.

EXAMPLE 2

Figure 3:
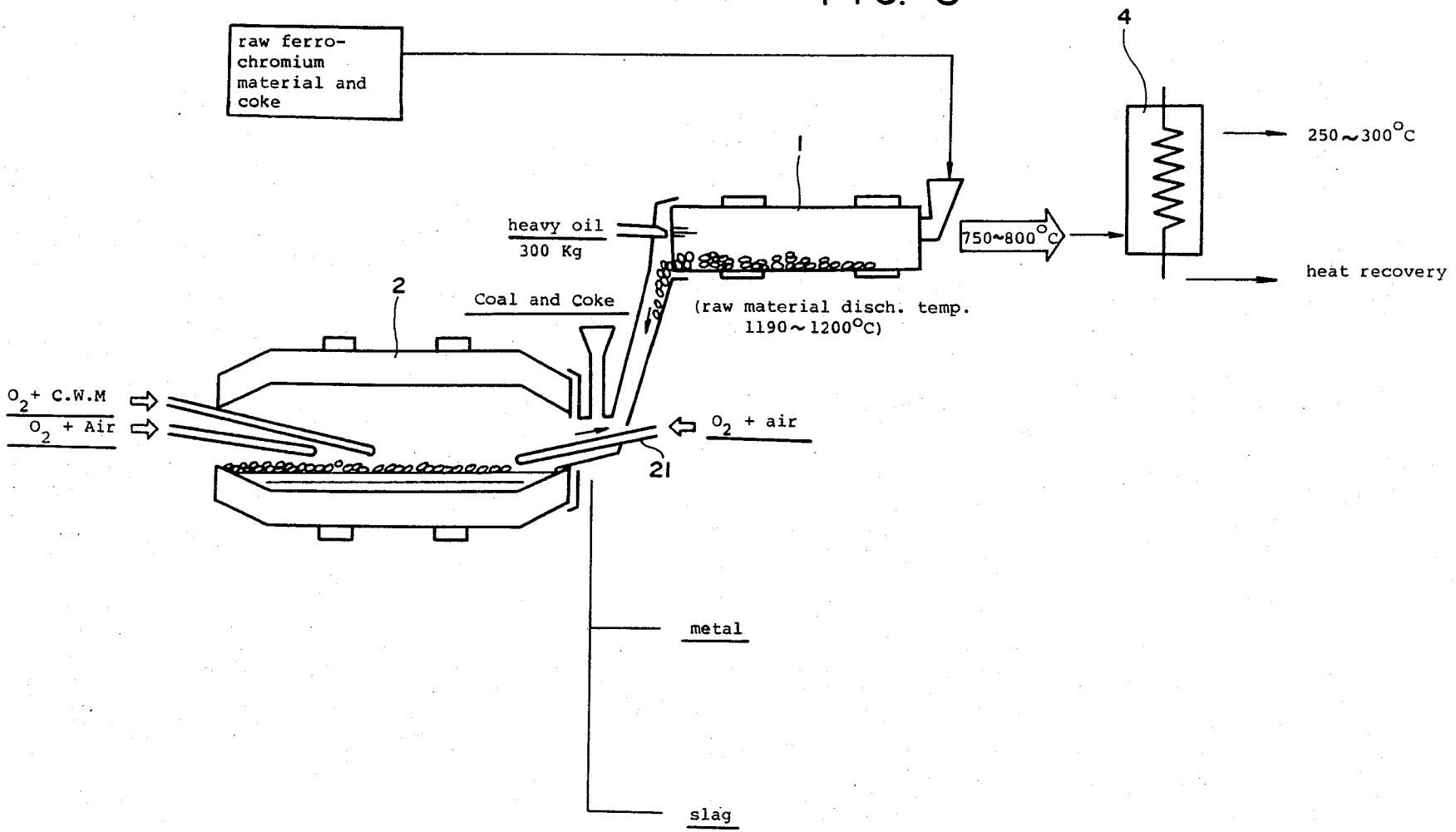
FIG. 3 is a diagram showing the process of the second embodiment of the invention.

The Example refers to the production of high carbon ferrochromium. The apparatus shown in FIG. 3 was used for production of 1 ton of high carbon ferrochromium.

The rotary furnace 2 open at both ends (inside diameter, 1 m, outside diameter, 2 m; length, 3 m) was rotated at 8 rpm with the axis thereof horizontal. Coke and C-containing chromium or pellets were charged into the furnace at 1200° C. after pre-reduction in the rotary kiln 1. Following pre-reduction, the raw materials had the following chemical composition (wt. percent) and mixture ratio.

C-containing Cr pellets (Cr ores, 1900 kg; calcined lime, 254 kg; silica, 26 kg; mill scale, 5 kg; contained coke, 200 kg); coke, 200 kg.

Chemical composition: M.Cr, 13%, $Cr_2O_3$, 26% M.Fe, 16%, $SiO_2$, 7%; MgO, 15%, $Al_2O_3$, 13%.

Figure 4:
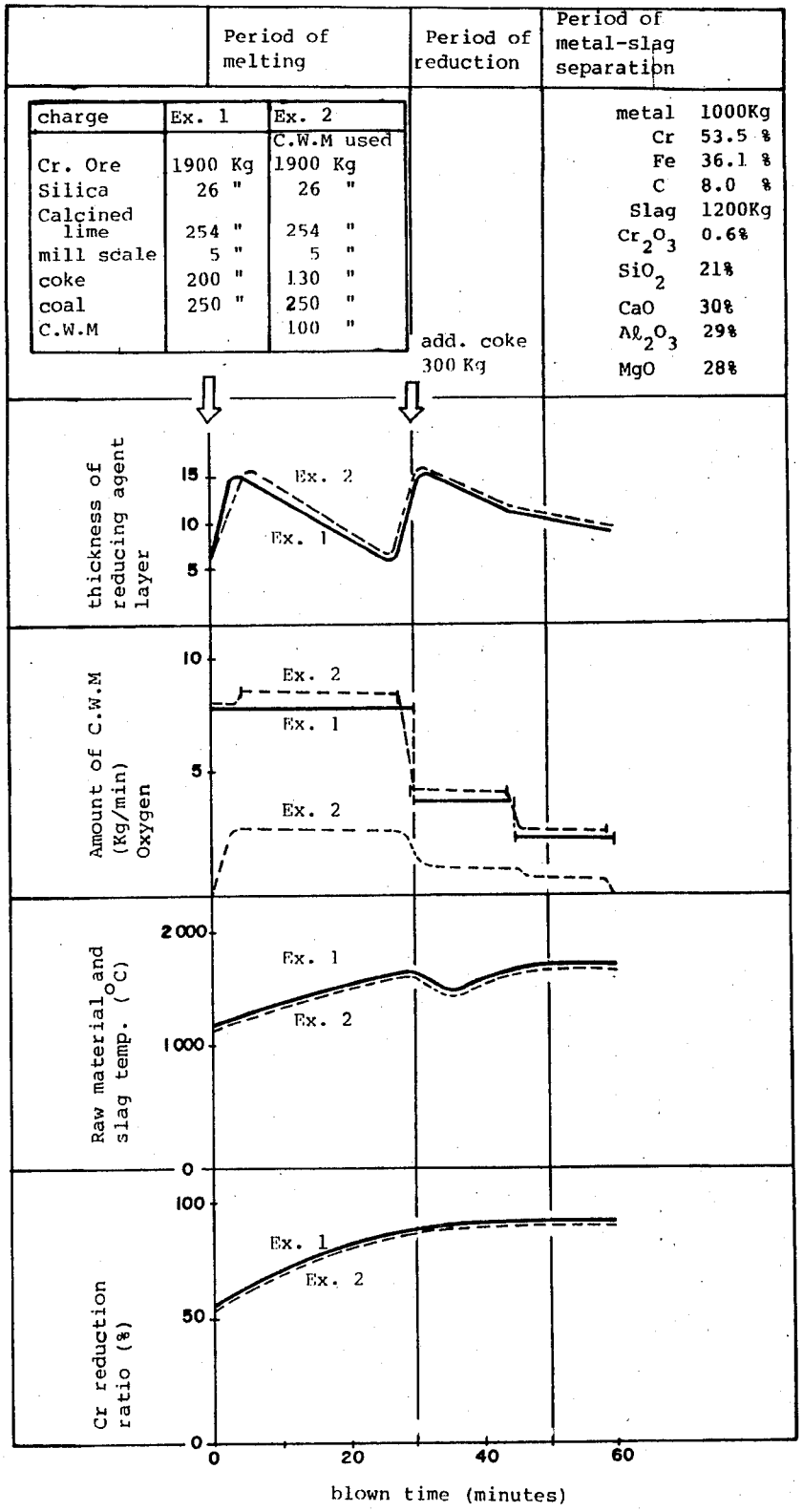
FIG. 4 is a chart showing the reducing agent layer thickness and other operating parameters for the second embodiment with respect to elapsed time.

Oxygen and oxygen-enriched air were blown from both furnace ends onto the surface of the reducing agent and C.W.M. (coal water mixture or slurry or emulsion) was blown through one furnace end onto the same surface. FIG. 4 shows examples of the oxygen blow pattern, thickness transition of the reducing agent on the surface of molten material, C.W.M. blow pattern, changes in slag temperature and changes in Cr reduction rate.

The materials were melted in about 30 minutes. The slag temperature at this time was 1650° C. 300 kg of additional coal and coke were charged at this time for forming a bed layer higher than 5 cm on the slag surface. The material was tapped out after blow was terminated in 60 minutes. The slag temperature at this time was 1750° C. and the metal and slag having the following weight and chemical composition (wt. percent) were obtained.

| | Cr | | Fe | | C |
|---|---|---|---|---|---|
| metal, 1000 kg | 53.5% | | 36.1% | | 8.0% |
| $Cr_2O_3$ | $SiO_2$ | CaO | $Al_2O_3$ | MgO | |
| slag, 1200 kg | 0.6% | 21% | 30% | 29% | 28% |

A skimmer was provided at the time of tapping to the tapping hole or mouth to cause the residual excess coke to remain in the furnace for recirculation of the reducing agent.

The gases evolved in the process of smelting reduction of the ores were exhausted at about 1200° C. These gases were conducted to a rotary kiln 1 (processing capacity, 2000 kg charge/hour; inside diameter, 1.0 m; length, 10 m; 1 rpm) while 30 $Nm^3$ per minute of air and 6 kg per minute of heavy oil were blown for heat compensation to carry out pre-reduction of the raw materials (C-containing Cr pellets) and heating of coke. The gases exhausted at about 800° C. from the rotary kiln 1 were passed through the heat exchanger 4 for heat recovery of about 20000 kcal per hour.

FIG. 4 shows the relation between the blowing time, thickness of the layer of reducing agent and the amount of coal water mixture.

EXAMPLE 3

Figure 5:
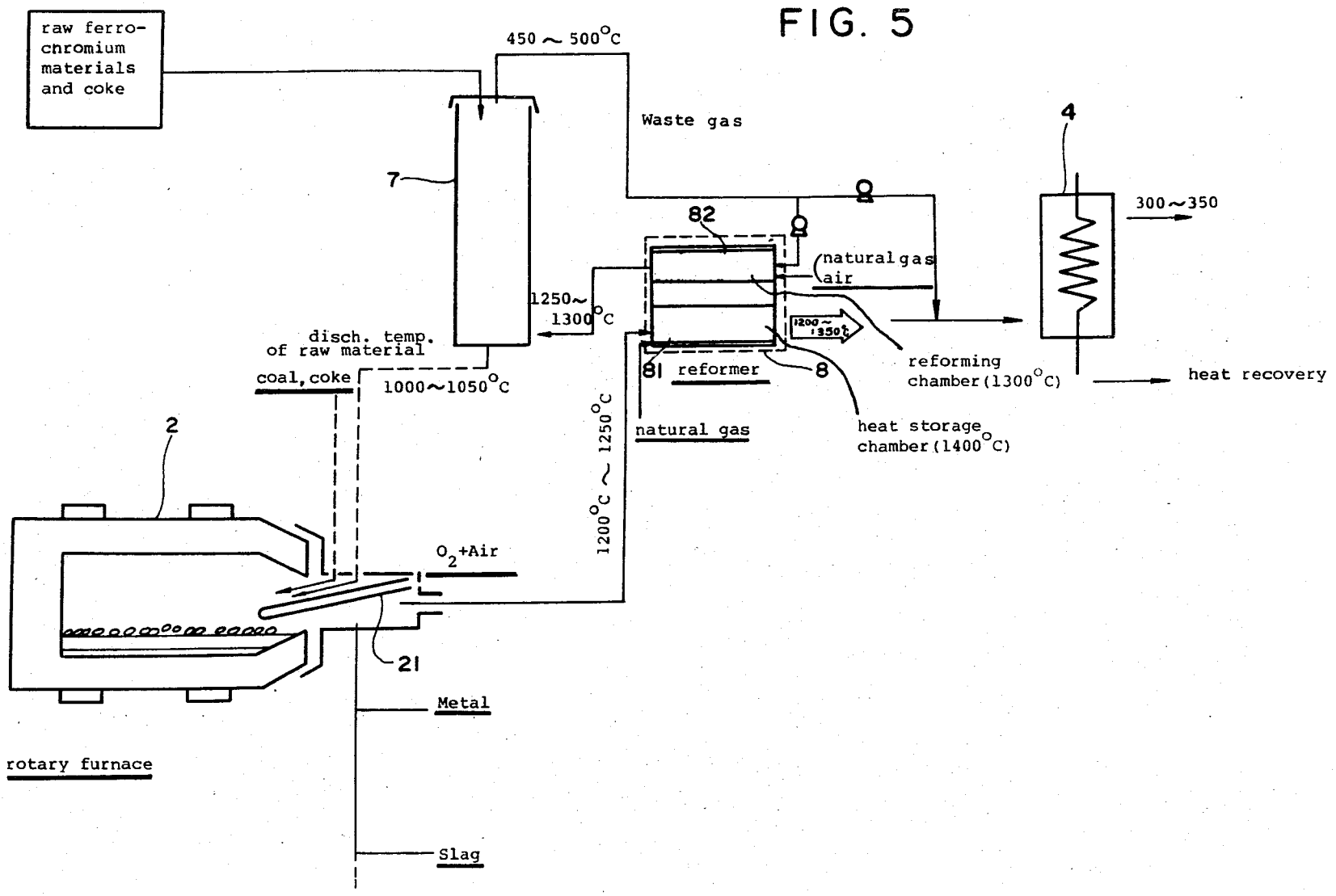
FIG. 5 is a diagram showing the process of a third embodiment of the present invention.

This Example refers to the production of high carbon ferrochromium. The apparatus shown in FIG. 5 was used for production 1 ton of high carbon ferrochromium.

A rotary furnace 2 open at one end with inside diameter of 1 m, outside diameter of 2 m and length of 3 m was placed with its axis horizontal and rotated at 8 rpm. The raw materials, fluxes, coke and coal, heated to 1000° C. in the shaft type reducing furnace 7, was mixed at a rate of 1900 kg of C-containing Cr pellets, 254 kg of calcined lime, 26 kg of silica, 5 kg of mill scale, 400 kg/coke and 250 kg of coal, and charged into the furnace.

In the rotary furnace, oxygen was blown onto the surface of coke and coal through a water-cooled lance 21 inclined 15° relative to the rotary axis. Oxygen blow was started at 10 $Nm^3$/min. and the material was smelted in about 40 minutes. The slag temperature at this time was 1650° C. Additional coke and coal were charged since this time at the rate of 10 kg/min. for forming a bed layer of certain thickness on the slag surface. Oxygen was blown at 6 $Nm^3$/min. in the 40 to 55 minute period and at 3 $Nm^3$/min. in the 55 to 70 minute period. The blowing was terminated in 70 minutes and the material was tapped out. The slag temperature at this time was 1750° C. and the metal and slag having the following weight and chemical composition (wt. percent) were obtained.

| | Cr | Fe | Si | C |
|---|---|---|---|---|
| metal, 1000 kg | 53.5% | 36.2% | 1.5% | 8.2% |

| | $Cr_2O_3$ | $SiO_2$ | CaO | $Al_2O_3$ | MgO |
|---|---|---|---|---|---|
| slag, 1200 Kg | 0.5% | 22% | 30% | 29% | 27% |

A skimmer was provided at the tapping hole or mouth to cause the residual excess coke to remain in the furnace at the time of tapping for recirculation of such coke.

The gases evolved in the process of smelting reduction of the ores were conveyed to a heat storage chamber 81 of a reformer 8 where a small amount of natural gas was mixed into the gases and the resulting mixture was burned to heat the bricks to about 1400° C. for heat storage. Exhaust gases from the shaft furnace 7 mixed with the natural gas were passed through this reforming heat storage chamber 82 for producing reducing gases by reforming at about 1250° C. The resulting reducing gases were supplied into shaft type reducing furnace 7 for reducing FeO in the pellets to Fe. The raw materials were discharged at about 1050° C. and charged into rotary furnace 2. The exhaust gases from the shaft type reducing furnace 7 were returned into the reformer 8 for recirculation.

The C-containing Cr pellets, resulting from pre-reduction in the shaft type reducing furnace 7, had the chemical composition of 43 wt.% of $Cr_2O_3$, 7 wt.% of $SiO_2$, 15 wt.% of MgO and 13 wt.% of $Al_2O_3$.

The exhaust gases at about 1200° C. from the reformer 8 were passed through heat exchanger 4 for heat recovery of 200000 kcal per hour.

Table 1 tabulates recorded values as obtained when a rotary kiln or a shaft furnace was used for pre-heating and pre-reduction, while Table 2 tabulates typical values for total energy consumption and costs for the cases of the inventive method and the electric arc furnace method.

It is seen from these Tables that the inventive method enables ferrochromium to be produced by using inexpensive readily available coal and without using expensive electric power thus realizing energy saving.

TABLE 1

| | | Example-1 rotary kiln (pre-heating) | | | |
|---|---|---|---|---|---|
| | | Case (1) $O_2$ − Coke | Case (2) $O_2$ + Air Coke + Coal | Case (3) C-containing | Case (4) Oxy-fuel |
| Pre-heated or pre-reduced materials | Cr Ore | 1,900 Kg | 1,900 Kg | 1,900 Kg | 1,900 Kg |
| | Silica | 26 Kg | 26 Kg | 26 Kg | 26 Kg |
| | Calcined lime | 254 Kg | 254 Kg | 254 Kg | 254 Kg |
| | mill scale | 5 Kg | 5 Kg | 5 Kg | 5 Kg |
| | Coke | 750 Kg | 400 Kg | 550 Kg | 260 Kg |
| Carbon materials | Coke | — | — | — | — |
| | Coal | — | 400 Kg | 250 Kg | 400 Kg |
| Fuel | $O_2$ | 650 $Nm^3$ | 590 $Nm^3$ | 630 $Nm^3$ | 670 $Nm^3$ |
| | $O_2$-enriched air | — | 200 $Nm^3$ | — | — |
| | Oxy-fuel | — | — | — | 200 Kg |
| Pre-heating temperature of raw materials | | 490° C. | 510° C. | 500° C. | 500° C. |
| Pre-reduction ratio | | — | — | — | — |
| Metal | weight | 990 Kg | 990 Kg | 1,050 Kg | 1,000 Kg |
| | Composition | 53.5% Cr<br>36.0% Fe<br>7.5% C | 53.8% Cr<br>35.5% Fe<br>7.8% C | 54.5% Cr<br>34.5% Fe<br>8.0% C | 53.2% Cr<br>37.5% Fe<br>7.8% C |
| Slag | weight | 1,150 Kg | 1,200 Kg | 1,200 Kg | 1,250 Kg |
| | Composition | 0.5% $Cr_2O_3$<br>22% $SiO_2$<br>30% CaO<br>31% $Al_2O_3$ | 0.5% $Cr_2O_3$<br>20% $SiO_2$<br>30% CaO<br>29% $Al_2O_3$ | 0.5% $Cr_2O_3$<br>20% $SiO_2$<br>30% CaO<br>29% $Al_2O_3$ | 0.6% $Cr_2O_3$<br>21% $SiO_2$<br>31% CaO<br>30% $Al_2O_3$ |
| Heat | | 20,000 | 20,000 | 20,000 | 20,000 |

TABLE 1-continued

| recovery | | Kcal/Hr | Kcal/Hr | Kcal/Hr | Kcal/Hr |
|---|---|---|---|---|---|
| | | Example-2 rotary kiln (Cr, 55% Fe 50% reduction) | | | |
| | | Case (1) $O_2$ − Coke | Case (2) $O_2$ − Coke | Case (3) $O_2$ + Air − Coke + Coal | Case (4) C-containing |
| Pre-heated or pre-reduced materials | Cr Ore | 1,900 Kg | 1,900 Kg | 1,900 Kg | 1,900 Kg |
| | Silica | 26 Kg | 26 Kg | 26 Kg | 26 Kg |
| | Calcined lime | 254 Kg | 254 Kg | 254 Kg | 254 Kg |
| | mill scale | 5 Kg | 5 Kg | 5 Kg | 5 Kg |
| | Coke | 440 Kg | 200 Kg | 200 Kg | 130 Kg |
| Carbon materials | Coke | — | — | — | — |
| | Coal | — | 250 Kg | 280 Kg | 250 Kg |
| Fuel | $O_2$ | 400 $Nm^3$ | 380 $Nm^3$ | 420 $Nm^3$ | 430 $Nm^3$ |
| | $O_2$-enriched air | — | 100 $Nm^3$ | — | — |
| | Oxy-fuel | — | — | — | 100 Kg |
| Pre-heating temperature of raw materials | | 1190° C. | 1210° C. | 1200° C. | 1210° C. |
| Pre-reduction ratio | | Cr:52% Fe:80% | Cr:55% Fe:85% | Cr:54% Fe:80% | Cr:56% Fe:80% |
| Metal | Weight | 1,010 Kg | 990 Kg | 1,000 Kg | 1,010 Kg |
| | Composition | 53.4% Cr 37.2% Fe 76% C | 54.2% Cr 36.4% Fe 8.0 C | 53.8% Cr 35.8% Fe 7.9% C | 54.0% Cr 34.3% Fe 8.0% C |
| Slag | Weight | 1,230 Kg | 1,250 Kg | 1,090 Kg | 1,200 Kg |
| | Composition | 0.7% $Cr_2O_3$ 22% $SiO_2$ 30% CaO 31% $Al_2O_3$ | 0.6% $Cr_2O_3$ 20% $SiO_2$ 29% CaO 32% $Al_2O_3$ | 0.8% $Cr_2O_3$ 21% $SiO_2$ 30% CaO 30% $Al_2O_3$ | 0.5% $Cr_2O_3$ 20% $SiO_2$ 33% CaO 29% $Al_2O_3$ |
| Heat recovery | | 155,000 kcal/Hr | 165,000 kcal/Hr | 160,000 kcal/Hr | 163,000 kcal/Hr |
| | | Example-3 shaft furnace, only 85% Pre-reduction | | | |
| | | Case (1) Oxy-fuel | Case (2) $O_2$ + Air − Coke | Case (3) C-containing | Case (4) Oxy-fuel |
| Pre-heated or pre-reduced materials | Cr Ore | 1,900 Kg | 1,900 Kg | 1,900 Kg | 1,900 Kg |
| | Silica | 26 Kg | 26 Kg | 26 Kg | 26 Kg |
| | Calcined lime | 254 Kg | 254 Kg | 254 Kg | 254 Kg |
| | mill scale | 5 Kg | 5 Kg | 5 Kg | 5 Kg |
| | Coke | 480 Kg | 230 Kg | 200 Kg | 160 Kg |
| Carbon materials | Coke | — | — | — | — |
| | Coal | — | 270 Kg | 300 Kg | 270 Kg |
| Fuel | $O_2$ | 420 $Nm^3$ | 410 $Nm^3$ | 440 $Nm^3$ | 450 $Nm^3$ |
| | $O_2$-enriched air | — | 100 $Nm^3$ | — | — |
| | oxy-fuel | — | — | — | 100 Kg |
| Pre-heating temperature of raw materials | | 1,000° C. | 1,050° C. | 1,040° C. | 1,050° C. |
| Pre-reduction ratio | | Fe:80% | Fe:84% | Fe:85% | Fe:85% |
| Metal | Weight | 1,000 Kg | 1,010 Kg | 990 Kg | 990 Kg |
| | Composition | 53.1% Cr 36.7% Fe 7.8% C | 53.4% Cr 36.1% Fe 7.7% C | 53.6% Cr 36.2% Fe 7.9% C | 53.6% Cr 36.4% Fe 7.8% C |
| Slag | Weight | 1,300 Kg | 1,180 Kg | 1,200 Kg | 1,100 Kg |
| | Composition | 0.6% $Cr_2O_3$ 21% $SiO_2$ 32% CaO 27% $Al_2O_3$ | 0.8% $Cr_2O_3$ 23% $SiO_2$ 31% CaO 28% $Al_3O_3$ | 0.7% $Cr_2O_3$ 20% $SiO_2$ 33% CaO 28% $Al_2O_3$ | 0.6% $Cr_2O_3$ 22% $SiO_2$ 33% CaO 30% $Al_2O_3$ |
| Heat recovery | | 210,000 kcal/Hr | 220,000 Kcal/Hr | 210,000 Kcal/Hr | 220,000 Kcal/Hr |

TABLE 2

| | | electric arc furnace method (conventional) | inventive (coal used) | inventive (Coal to Coke ratio 50:50) |
|---|---|---|---|---|
| Main | *electric power 2450 Kcal/KWH | 3,100 × 2450 = 7595 × $10^3$ | — | — |
| Energy Coke | 7200 Kcal/Kg | 395 × 7200 = 2844 × $10^3$ | — | 438 × 17200 = 3154 × $10^3$ |
| Coal | 7500 Kcal/Kg | | 875 × 7500 = 6,562 × $10^3$ | 437 × 7500 = 3278 × $10^3$ |
| Oxygen | 1600 Kcal/$Nm^3$ | | 733 × 1600 = 1173 × $10^3$ | 1173 × $10^3$ |
| Total energy consumption (ratio) | | 10,439 × $10^3$ Kcal (100) | 7735 × $10^3$ Kcal (74) | 7,605 × $10^3$ Kcal (73) |

*Conversion efficiency from heavy oil to electric power 35%.

What is claimed is:

1. A method for the production of ferrochromium comprising (1) preheating or prereducing a mixture comprising chromium ores, fluxes, and a carbonaceous reducing agent in a first furnace, said first furnace selected from a rotary kiln, a shaft furnace or a fluidized bed, (2) discharging said preheated or prereduced mixture from (1) into a second furnace, said second furnace comprising a rotary furnace having its axis positioned horizontal, or at an angle no greater than 35 degrees to horizontal, (3) smelting and reducing the mixture of said second furnace by blowing oxygen or oxygen-enriched air into said second furnace, and (4) tapping out the molten metal ferrochrome, the method further characterized in that the exhaust gases from (3) are utilized as the heat source for (1).

2. The method of claim 1 wherein the reaction of oxygen with coal or coke provides the second furnace heat source.

3. The method for the production of ferrochromium according to claim 1, wherein lumpy and/or fine chromium ore or chromium ore pellets or briquettes or carbon-containing chromium ore pellets or briquettes obtained by mixing and agglomerating chromium ores, fluxes and a carbonaceous reducing agent are used as charge materials.

4. The method for the production of ferrochromium according to claim 1, wherein said rotary furnace is open at both ends or at one end.

5. The method for the production of ferrochromium according to claim 1, wherein the upper limit of temperature for preheating said charged materials is 1800° C.

6. The method for the production of ferrochromium according to claim 1, wherein exhaust gases from said preheating or prereducing process are introduced to a heat recovery process to recover the exhaust heat.

7. The method for the production of ferrochromium according to claim 3, wherein a skimmer is attached to the tapping mouth at the time of tapping from said rotary kiln to cause unreacted excess coke to remain in the furnace.

* * * * *